US011492785B2

(12) United States Patent
Tzeng

(10) Patent No.: US 11,492,785 B2
(45) Date of Patent: Nov. 8, 2022

(54) SIMPLE WATER OUTFLOW DEVICE

(71) Applicant: NCIP INC., Taipei (TW)

(72) Inventor: Rong-Chyan Tzeng, Taipei (TW)

(73) Assignee: NCIP INC., Taipei (TW)

( * ) Notice: Subject to any disclaimer, the term of this patent is extended or adjusted under 35 U.S.C. 154(b) by 187 days.

(21) Appl. No.: 17/111,441

(22) Filed: Dec. 3, 2020

(65) Prior Publication Data

US 2022/0178119 A1 Jun. 9, 2022

(51) Int. Cl.
*E03C 1/02* (2006.01)

(52) U.S. Cl.
CPC ..... *E03C 1/023* (2013.01)

(58) Field of Classification Search
CPC ..... E03C 1/023; E03C 1/025; E03C 1/0403
See application file for complete search history.

(56) References Cited

U.S. PATENT DOCUMENTS

2004/0040603 A1* 3/2004 Shieh ..... F16K 11/044 137/597
2020/0318326 A1* 10/2020 Lu ..... E03C 1/0403
2021/0025149 A1* 1/2021 Huang ..... E03C 1/023
2021/0388582 A1* 12/2021 Currey ..... E03C 1/0403

* cited by examiner

*Primary Examiner* — Christine J Skubinna
(74) *Attorney, Agent, or Firm* — WPAT, PC

(57) ABSTRACT

A simple water outflow device which is an outflow device with an inflow pipe and an outflow pipe. The simple water outflow device consists of a body, an inflow pipe, and an outflow pipe. A discharge control valve is installed inside the body. The outflow pipe and body are a one-piece design created using injection molding technology. The inflow pipe is soft and flexible. There is an axial inflow channel and radial groove inside the body. The groove and the inflow channel are perpendicularly connected. There is a circular magazine on the upper end of the inflow pipe. A leakproof O-shape ring is placed on the circular magazine. The upper end of the inflow pipe is inserted into the inflow channel. A C-shape shackle is inserted into the groove of the body, and shackled into the circular magazine of the inflow pipe. This secures the inflow pipe on the body.

6 Claims, 5 Drawing Sheets

SIMPLE WATER OUTFLOW DEVICE

FIELD OF THE INVENTION

This invention is a simple water outlet device. It features a one-piece design combining a water outflow pipe and a body. The inflow pipe is connected to the device using an insert-and-shackle mechanism. This allows the overall volume to be much more compact.

BACKGROUND OF THE INVENTION

The simple water outflow device is an outflow device with an inflow pipe and an outflow pipe. The device consists of a plastic body and a metal cover. The plastic body is vulnerable to impact, which makes the metal cover necessary in order to increase the overall resistance of the body. There is a discharge control valve installed inside the body. The body has to be connected to an inflow pipe and an outflow pipe.

The inflow and outflow pipes are connected to the body of the simple water outflow device with screw nuts. To connect the pipes and the body, a nut is screwed to the top of the inflow and outflow pipes. The nuts are then screwed onto the preset screw pipe of the body. A gasket is inserted between the inflow and outflow pipes and the screw pipes of the body to prevent leakage. Leakproof is achieved through extrusion on the gasket by the nuts and the body. For the simple water outflow device to use inflow and outflow pipes with nuts, the external diameter of the body has to be long enough in order to leave installment space for two additional nuts.

SUMMARY OF THE INVENTION

The primary purpose of this invention is to offer a simple water outflow device. Thanks to one-piece design combining the pipe and the body, and an inflow pipe using shackle connection, the simple water outflow device has a more compact volume, which perfectly serves its purpose.

The simple water outflow device consists of one body, one inflow pipe, one outflow pipe and one C-shape shackle. A discharge control valve is installed inside the body. The outflow pipe and body are one-piece using injection molding technology. The inflow pipe is soft and flexible. There is an axial inflow channel and radial groove inside the body. The groove and the inflow channel are perpendicularly connected. There is a circular magazine on the upper end of the inflow pipe. The upper end of the inflow pipe is inserted into the inflow channel. The C-shape shackle is inserted into the groove of the body, and shackled into the circular magazine of the inflow pipe in order to secure the inflow pipe.

There is a leakproof O-shape ring installed onto the inflow pipe. The O-shape ring is placed on the circular magazine.

There is even a piping positioning component in this invention. The piping positioning component is in a ring shape and has an open tunnel. The open tunnel has two interconnected round holes, to which the inflow and outflow pipes are inserted.

There is even a metal cover designed for this invention. The metal cover sleeves the body and the exterior of the piping positioning component, and is glued to the body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
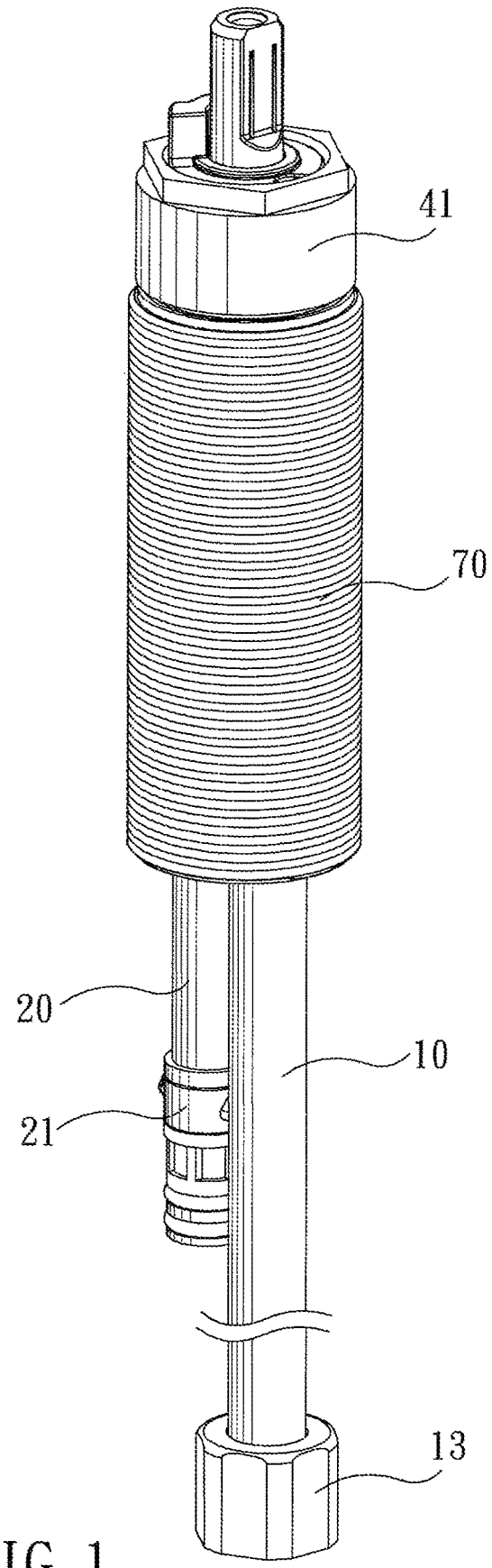
FIG. 1 is the exterior drawing of the first example of this invention.
Figure 2:
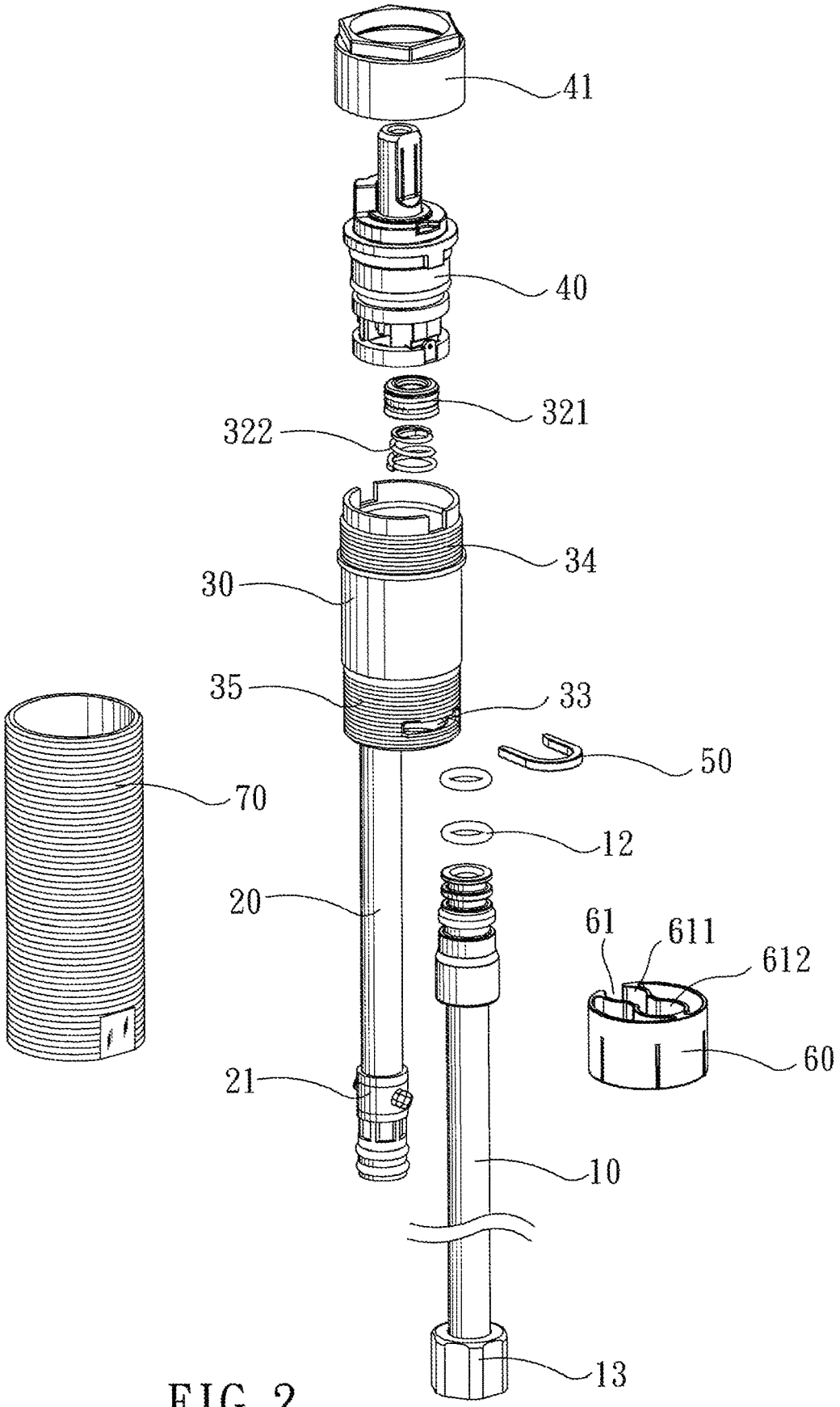
FIG. 2 is the breakdown drawing of the example shown in FIG. 1.
Figure 3:
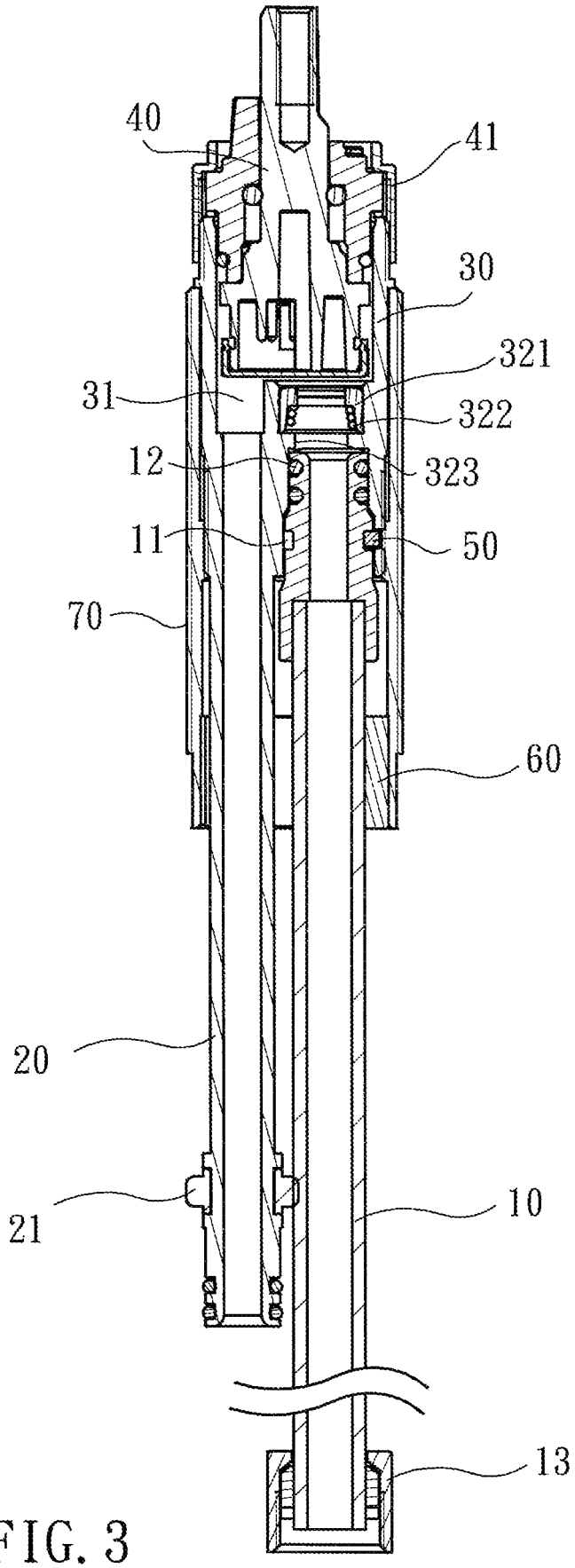
FIG. 3 is the sectional drawing of the example shown in FIG. 1.

Please see FIGS. 1 and 3. This invention is a simple water outflow device consisting of one inflow pipe 10 and one outflow pipe 20. The simple water outflow device consists of a body 30, an inflow pipe 10, and an outflow pipe 20. There is a discharge control valve 40 installed inside 11 the body 30. A handle can be installed to the top of the water discharge valve 40 (not shown in the Figure). The handle is responsible for the starting and stopping of water outflow. The outflow pipe 20 and the body 30 are a one-piece design created with injection molding technology. Also, the outflow pipe 20 and the inside 11 of the body 10 are interconnected. The inflow pipe 10 is a flexible soft pipe, which can also be connected to the body 30.

Figure 4:
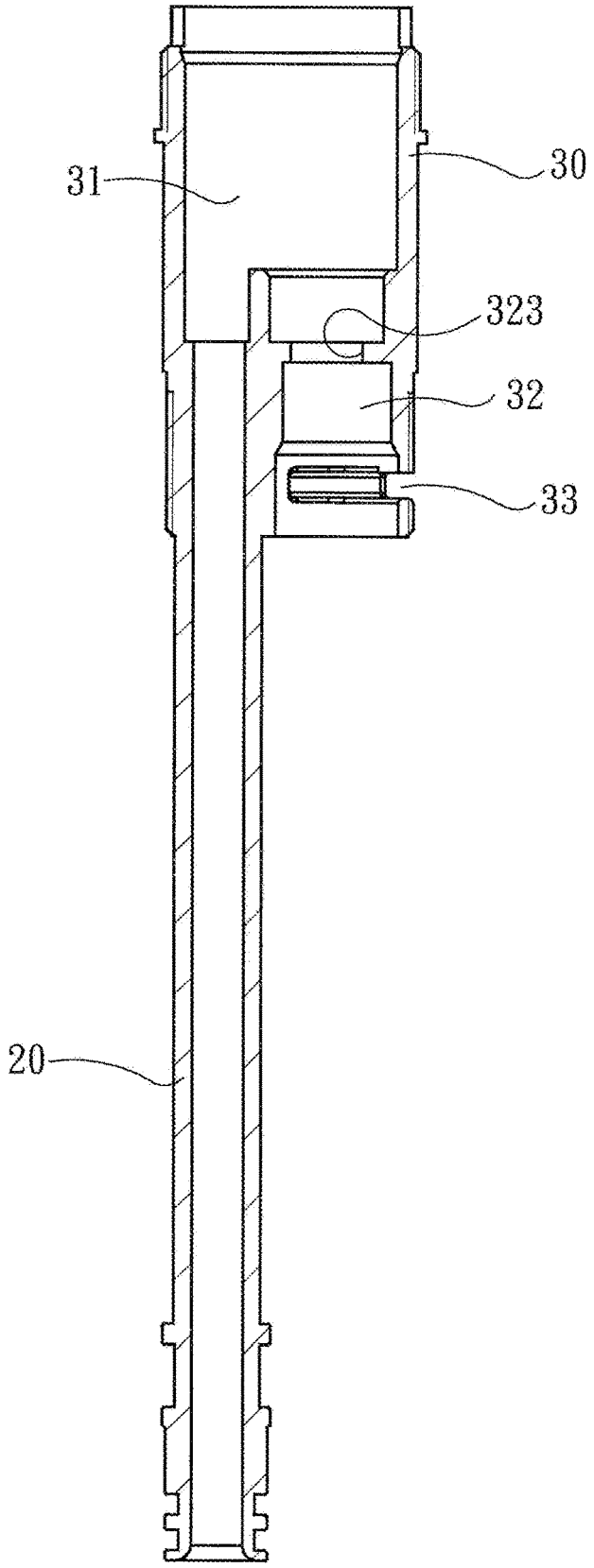
FIG. 4 is the sectional drawing of the body.
Figure 5:
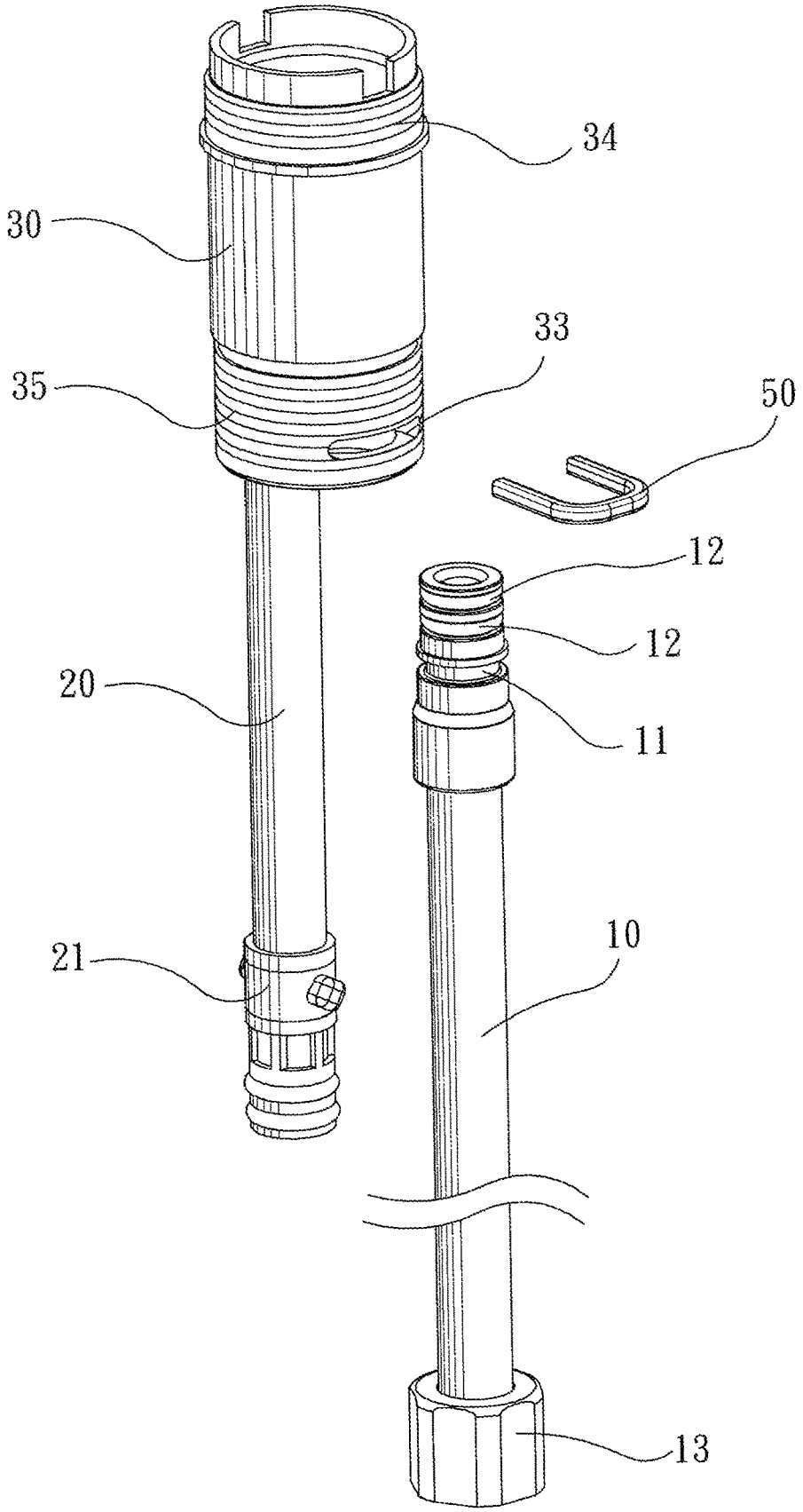
FIG. 5 is the breakdown drawing of inflow pipe and the body.

Please see FIG. 4. There is an axial inflow channel 32 and radial groove 33 inside the body 30 mentioned above. The inflow channel 32 and the inside 31 of the body 30 are interconnected. The groove 33 and the inflow channel 32 are perpendicularly connected, allowing the groove 33 and the inflow channel 32 to be interconnected. There is a circular magazine 11 on the upper end of the inflow pipe 10. A leakproof O-shape ring 12 is placed on the circular magazine 11. In this example, there are two leakproof O-shape rings 12. The upper end of the inflow pipe 10 is inserted into the inflow channel 32 of the body 30, where the leakproof O-shape ring 12 prevents leakage. Please see FIG. 5. A C-shape shackle 50 is inserted into the groove 33 of the body 10, and shackled into the circular magazine 11 of the inflow pipe 10. This prevents the inflow pipe 10 from moving and secures the inflow pipe 10 on the body 30. There is an inner flange 323 on the inner wall of the inflow channel 32. The inflow pipe 10 is inserted in place when the upper end of the inflow pipe 10 touches the bottom of the inner flange 323. The next step is the insertion of the C-shape shackle 50.

The first thread 34 is located on the upper end of the outer wall of the body 30. After the discharge control valve 40 is installed inside 31 the body 30, a nut 41 is then screwed onto the first thread 34 of the body 10. This allows pressure regulation and restraining of the discharge valve 40 to be done.

There is even a piping positioning component 60 in this simple water outflow device. The main purpose of the piping positioning component 60 is to secure the relative location of the inflow pipe 10 and outflow pipe 20. This prevents the connection between the inflow pipe 10 and the body 30 from being affected when the inflow pipe 10 is being flexed. The piping positioning component 60 is in a ring shape and has an open tunnel 61. The open tunnel 61 has two interconnected circular holes 611 and 612. The inflow pipe 10 and outflow pipe 20 can each be inserted into the circular holes 611 and 612 of the open tunnel 61. Therefore, when the inflow pipe 10 is being flexed, the top bending position of the inflow pipe 10 is at the lower end of the piping positioning component 60. This allows the connection between in inflow pipe 10 and the body 30 to stay unaffected.

There is even a metal cover 70 designed for this simple water outflow device. The metal cover 70 sleeves the body 30 and the exterior of the piping positioning component 60. The metal cover 70 is glued to the body 30. The second thread 35 is located at the outer wall of the body 30. When the metal cover 70 is combined with the body 30, the glue is filled into the second thread 35, which in turn increases the adhesion of the metal cover 70 and the body 30. This prevents the metal cover 70 from raveling off. The metal cover 70 has an exterior thread (not shown in the Figure) which allows the simple water outflow device to be installed on an operating platform (not shown in the Figure).

A quick-installing connector 21 can be installed to the lower end of the outflow pipe 10 (not shown in the Figure). The lower end of the of the inflow pipe 10 has a nut 13 which can be screwed to a hose that is connected to the source of water (not shown in Figure). During operation, the inflow pipe 10 is longer than the outflow pipe 20. When the outflow pipe 20 is connected to the hose, the connection will not be affected by the inflow pipe 10 because it is soft and can be slightly flexed. The fact that the inflow pipe 10 is longer makes the position of the nut 13 lower than the lower end of the outflow pipe 20. Therefore, they stay separated. Ultimately, the nut 13 will not press the outflow pipe 20, which is hard.

The inflow channel 32 of the body 30 has a rubber ring 321 for water stopping. The rubber ring 321 is supported by a compression spring 322. With the combination of the rubber ring 321 and the compression spring 322, the water sent by the inflow pipe 10 can correctly flow into the discharge control valve 40. The rubber ring 321 and the compression spring 322 is a previously learned technology, not a feature of this invention. Hence, no further explanation is provided here.

To conclude, this simple water outflow device features an outflow pipe 20 with one-piece design and an inflow pipe 10 with insert-and-shackle mechanism, which leads to its compact volume and therefore explains the "simple" in its name. Also, the loosen-proof design of the outflow pipe 20 and the inflow pipe 10 increases the service life of this invention.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A simple water outflow device consisting of:

one body;

one inflow pipe;

one outflow pipe;

one C-shape shackle; and a discharge control valve installed inside the body;

wherein the outflow pipe and the body are an one-piece design created using injection molding technology, and the outflow pipe is interconnected with the body within the body;

wherein the inflow pipe is soft and flexible, the body has an axial inflow channel and radial groove internally; the axial inflow channel is interconnected with the body within the body; and the groove and the axial inflow channel are perpendicularly connected; and wherein a circular magazine is placed on an upper end of the inflow pipe, a leakproof O-shape ring is placed on the circular magazine, the upper end of the inflow pipe is inserted into the inflow channel, the C-shape shackle is inserted into the radial groove of the body and shackled into the circular magazine of the inflow pipe for securing the inflow pipe.

2. A simple water outflow device comprising:

one body;

a metal cover sleeving on and gluing to the body;

one inflow pipe;

one outflow pipe;

one C-shape shackle; and a discharge control valve installed inside the body;

wherein the outflow pipe and the body are an one-piece design created using injection molding technology, and the outflow pipe is interconnected with the body within the body;

wherein the inflow pipe is soft and flexible, the body has an axial inflow channel and radial groove internally; the axial inflow channel is interconnected with the body within the body; and the groove and the axial inflow channel are perpendicularly connected; and wherein a circular magazine is placed on an upper end of the inflow pipe, a leakproof O-shape ring is placed on the circular magazine, the upper end of the inflow pipe is inserted into the inflow channel, the C-shape shackle is inserted into the radial groove of the body and shackled into the circular magazine of the inflow pipe for securing the inflow pipe.

3. The simple water outflow device according to claim 2, wherein the inflow pipe is longer than the outflow pipe.

4. The simple water outflow device according to claim 2, further comprising:

a piping positioning component wherein the piping positioning component is in a ring shape and has an open tunnel, the open tunnel has two interconnected circular holes, and the inflow pipe and outflow pipe can each be inserted into the circular holes of the open tunnel.

5. The simple water outflow device according to claim 4, wherein the metal cover sleeves the body and the piping positioning component.

6. The simple water outflow device according to claim 2, wherein the inflow channel has an inner flange internally, and the upper end of the inflow pipe touches a bottom of the inner flange.

* * * * *